US010476140B2

(12) United States Patent
Urcia et al.

(10) Patent No.: US 10,476,140 B2
(45) Date of Patent: Nov. 12, 2019

(54) COMBINED STRUCTURAL AND ELECTRICAL REPAIR FOR MULTIFUNCTIONAL WIDEBAND ARRAYS

(71) Applicant: The Boeing Company, Chicago, IL (US)

(72) Inventors: Manny S. Urcia, Wildwood, MO (US); Andrew S. Niederschulte, Evanston, IL (US); Alec Adams, Woodway, WA (US)

(73) Assignee: The Boeing Company, Chicago, IL (US)

( * ) Notice: Subject to any disclaimer, the term of this patent is extended or adjusted under 35 U.S.C. 154(b) by 596 days.

(21) Appl. No.: 15/069,818

(22) Filed: Mar. 14, 2016

(65) Prior Publication Data

US 2017/0264007 A1 Sep. 14, 2017

(51) Int. Cl.
*H01Q 1/28* (2006.01)

(52) U.S. Cl.
CPC ..... *H01Q 1/286* (2013.01)

(58) Field of Classification Search
CPC .. H01Q 21/26; H01Q 21/0087; H01Q 21/064; Y10T 29/49002; Y10T 29/49016
See application file for complete search history.

(56) References Cited

U.S. PATENT DOCUMENTS 5,184,141 A * 2/1993 Connolly ..... H01Q 1/005 244/126
7,046,209 B1 5/2006 McCarville et al.
7,109,942 B2 9/2006 McCarville et al.
7,109,943 B2 9/2006 McCarville et al.
7,113,142 B2 9/2006 McCarville et al.
8,446,330 B1 5/2013 McCarville et al.
8,661,649 B1 3/2014 Urcia et al.
8,912,975 B1 12/2014 Hafenrichter et al.
9,059,517 B2 6/2015 Marshall, IV et al.
9,515,393 B2 * 12/2016 Marshall, IV ..... H01Q 21/0087
(Continued)

OTHER PUBLICATIONS

Doane et al., A Wideband, Wide Scanning Tightly Coupled Dipole Array With Integrated Balun (TCDA-IB), IEEE Transactions on Antennas and Propagation, pp. 4538-4548, vol. 61, No. 9, IEEE, Piscataway/USA.

*Primary Examiner* — Minh N Trinh
(74) *Attorney, Agent, or Firm* — Haynes and Boone, LLP

(57) ABSTRACT

A method for repair of a multifunctional wideband array includes processes and operations of assessing electrical and structural impairment to the multifunctional wideband array; cutting an opening in a superstrate of the multifunctional wideband array to expose an impaired backskin section of a lower electronics assembly of the multifunctional wideband array; replacing the impaired backskin section with a replacement backskin section; and repairing the opening in the superstrate. A system of multifunctional wideband array repair includes a core having longitudinal core strips and transverse core strips; a backskin having electronics connected to the core and providing electrical functionality enabling the core cells of the core to function as a phased array antenna aperture; a number of splice clips connecting longitudinal core strips to longitudinal repair core strips; and a section of the backskin electrically connected and structurally bonded to the repair core strips.

15 Claims, 13 Drawing Sheets

(56) References Cited

U.S. PATENT DOCUMENTS

| | | | | |
|---|---|---|---|---|
| 9,614,272 | B2 * | 4/2017 | Wallace | H01Q 1/42 |
| 2006/0097947 | A1 | 5/2006 | McCarville et al. | |
| 2017/0264007 | A1 * | 9/2017 | Urcia | H01Q 1/286 |

* cited by examiner

COMBINED STRUCTURAL AND ELECTRICAL REPAIR FOR MULTIFUNCTIONAL WIDEBAND ARRAYS

TECHNICAL FIELD

The present disclosure relates generally to multifunctional wideband arrays that perform functions including functioning as wideband phased array antennas and functioning as structural panels, and, more particularly, to damage repair for such multifunctional wideband antenna array panels to restore both structural and electrical function.

BACKGROUND

A phased array antenna may be integrated into a portion of the fuselage of an aircraft as part of a structural panel, such as a portion of the "skin" of the aircraft. For example, a phased array antenna panel may be integrated into the fuselage of an aircraft, and may be a load bearing portion of the fuselage. Such an antenna structural panel also may be integrated into, or otherwise applied to, wings, stabilizers, flaps, slats, doors, or other structures on an aircraft. The phased array antenna aspect of the panel can provide radio frequency beam forming and beam steering that can be used to provide directional communications, for example, or other functions such as radar detection and range finding.

A phased array antenna structural panel integrated into an aircraft may incur various impairments or damage to either its structural or electrical (e.g., radio frequency) functioning while the aircraft is in operation. As such, there is need for sophisticated repair systems and methods to restore the full functionality of the latest generation of multifunctional wideband antenna array structural panels.

SUMMARY

The multifunctional wideband array is a complex design which integrates wideband antenna elements into a structural component. Repair methods and systems are provided to ensure the multifunctional wideband array panel retains structural and electrical integrity after damage occurs. A novel method of repair is provided for a novel lower electronics assembly structure of the multifunctional wideband array for one or more embodiments. A system of repair, for example, includes standard core repair strips and standard superstrate repair patches.

In one or more embodiments, a method includes processes and operations of assessing impairment to a multifunctional wideband array; cutting an opening in a superstrate of the multifunctional wideband array to expose an impaired backskin section of a lower electronics assembly of the multifunctional wideband array; replacing the impaired backskin section with a replacement backskin section; and repairing the opening in the superstrate.

In another embodiment, a system includes a core having longitudinal core strips and transverse core strips; a backskin having electronics connected to the core and providing electrical functionality enabling the core cells of the core to function as a phased array antenna aperture; a number of splice clips connecting longitudinal core strips to longitudinal repair core strips; and a section of the backskin electrically connected and structurally bonded to the repair core strips.

In yet another embodiment, a method for repair of multifunctional wideband array panels includes various processes and operations, including maintaining an inventory of standardized longitudinal repair core strips and transverse repair core strips; maintaining an inventory of standardized superstrate repair patches; removing no more than one section of a backskin from a damaged multifunctional wideband array panel; cutting a standard sized, scarfed opening in a superstrate of the damaged multifunctional wideband array panel corresponding to the removed section of backskin; removing a section of a core corresponding to the removed section of backskin; trimming a remaining section of the core attached to a remaining section of the backskin to match a standardized length of one of the inventory of standardized longitudinal repair core strips; removing the trimmed section of core; replacing the removed core using the standardized longitudinal repair core strips and transverse repair core strips; installing a section of backskin to replace the removed section of backskin (including inserting the core feet of the replaced core into vias of the installed backskin, soldering the vias to connect the core and the backskin and soldering the installed section of backskin to an established backskin); and repairing the standard sized, scarfed opening using one of the inventory of standardized superstrate repair patches.

Figure 1A:
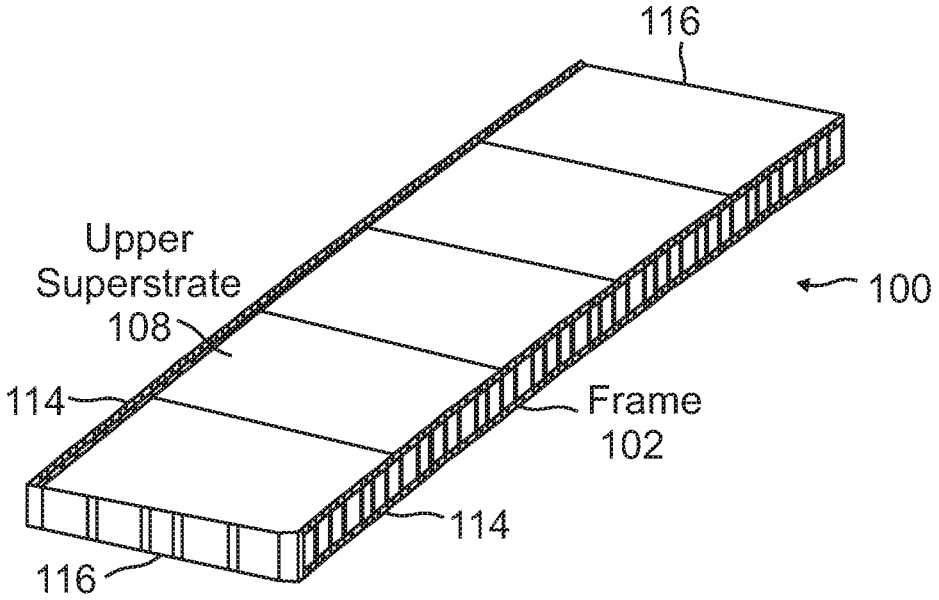
FIG. 1A is a perspective view, viewed from a top or upper side, of a multifunctional wideband array, in accordance with an embodiment of the disclosure.

Embodiments of the present disclosure and their advantages may be best understood by referring to the detailed description that follows. It should be appreciated that like reference numerals are used to identify like elements illustrated in one or more of the figures, in which the showings therein are for purposes of illustrating the embodiments and not for purposes of limiting them.

DETAILED DESCRIPTION

In general, the present disclosure describes examples of one or more embodiments for repair of multifunctional wideband antenna array structural panels, which may be more briefly referred to as a "multifunctional wideband array", "antenna structural panel", "phased array panel", "phased array aperture", "panel", and so forth.

Systems and methods for repairing multifunctional wideband array panels, in accordance with one or more embodiments, solve a problem of repairing a highly integrated panel that may include outer skins, core sections, and backskins. In one embodiment, the multifunctional wideband array is a highly complex structure which integrates outer skins, core sections comprising antenna elements, and backskins comprising electronics into a structural panel. A novel solution to the problem of repairing such a highly integrated and complex panel includes repair to backskin electrical components as well as repair to the antenna array cells and structural components. Replacing rather than repairing a panel is very costly due to the replacement costs of such a highly integrated panel. Thus, the solutions provided by one or more embodiments address an acute need for effective and economical repair of multifunctional wideband arrays in favor of simply replacing such panels.

According to one or more embodiments, damage scenarios for the multifunctional wideband array panel may be identified and repair solutions may be defined corresponding to various scenarios. In one or more embodiments, repair solutions may allow for consistent and reliable repair for the multifunctional wideband array to ensure proper structural and electrical functionality of the panel over time. In particular, embodiments provide a repair scenario for damaged backskins. The wideband array backskin contains the electronics components and is essential to the electrical functionality of the multifunctional wideband array. Thus, the solutions provided by one or more embodiments address a novel need for repair of multifunctional wideband arrays that includes repair of the backskin structure and electronics that is a novel aspect of the multifunctional wideband array according to one or more embodiments.

Examples of repair solutions for phased array apertures may be found in U.S. Pat. No. 8,912,975 B1, issued Dec. 16, 2014, entitled "Reworking Array Structures", which is incorporated by reference in its entirety, and which provides a repair scenario for replacing the outer skins and core sections for structural arrays, but does not, however, provide a repair scenario for lower electronics assemblies comprising backskins as seen in one or more embodiments of the present disclosure.

FIGS. 1A, 1B, 1C, and 1D illustrate, in accordance with one embodiment, a multifunctional wideband array 100 comprising components for functionalities including electrical functionality (e.g., core and backskin components for functioning as a wideband, phased array antenna aperture) and structural functionality (e.g., core and superstrate components for functioning as either a load bearing or non-load bearing part of a structure, such as an aircraft or airframe structure). Multifunctional wideband array 100 may be more succinctly referred to as panel 100.

Figure 1B:
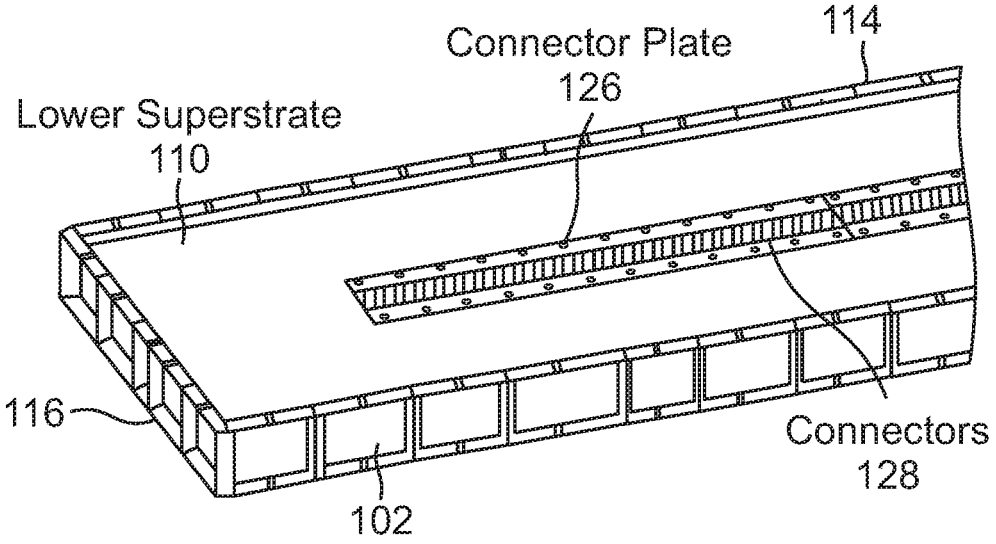
FIG. 1B is a perspective view, viewed from a bottom or lower side, of a multifunctional wideband array, in accordance with an embodiment.
Figure 1C:
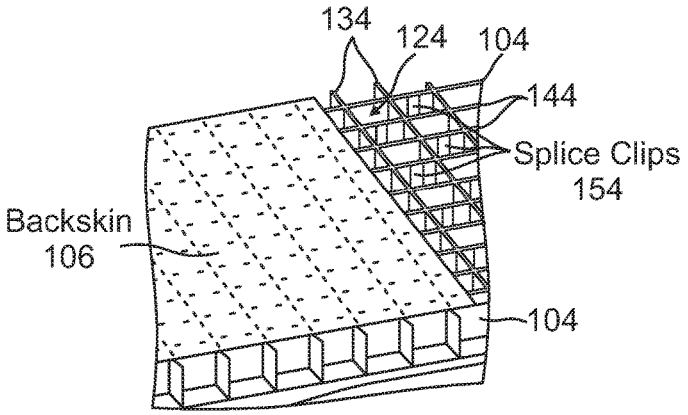
FIG. 1C is a perspective cut-away view, viewed from a bottom or lower side, showing internal details of a multifunctional wideband array, in accordance with an embodiment.
Figure 1D:
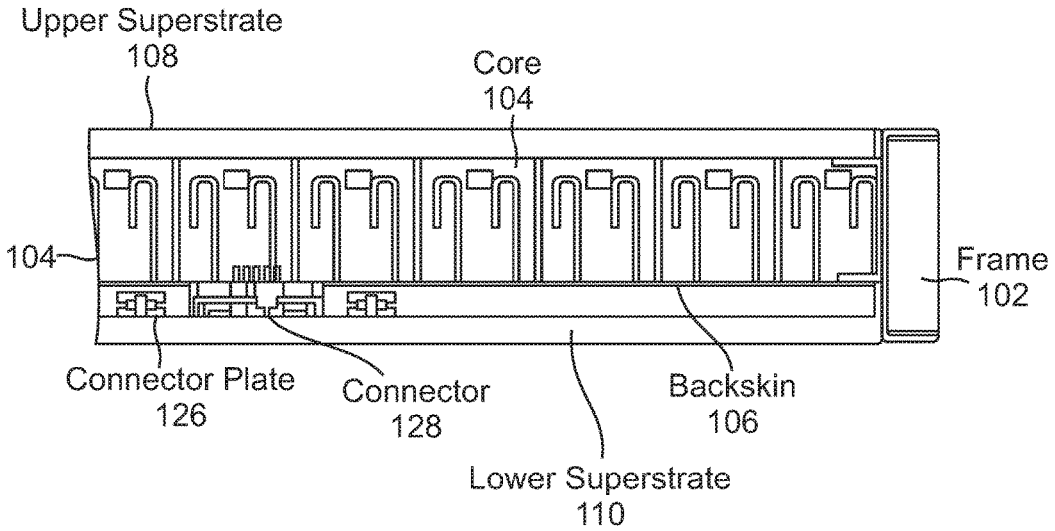
FIG. 1D is a cross sectional view diagram, which may be representative of either a transverse cut or a longitudinal cut through the structure, of a multifunctional wideband array, in accordance with an embodiment.

As seen in FIGS. 1A, 1B, and 1D, multifunctional wideband array 100 may include a frame 102 that may support, or be attached to, core 104 (seen in FIGS. 1C, 1D), backskin 106, upper, or top, superstrate 108, and lower, or bottom, superstrate 110. Upper superstrate 108 and lower superstrate 110 may be comprised of composite material. A side portion 114 of frame 102 may run longitudinally along the sides of panel 100; an end portion 116 of frame 102 may run transversely along the ends of panel 100. Backskin 106 may include electronics connected to core 104 and providing electrical functionality enabling core cells 124 of core 104 to function as a phased array antenna aperture. Backskin 106 may interface with, or attach to, a connector plate 126 that integrates connectors 128, which may connect backskin 106 electronics to interface with electronic devices external to multifunctional wideband array 100. Core 104 may comprise transverse core strips 134 and longitudinal core strips 144 that form the walls of each core cell 124. Splice clips 154 may provide structural and electrical interconnection between two longitudinal core strips 144, enabling the length of a longitudinal core strip 144 to be extended into another longitudinal core strip 144. Splice clips 154 may enable replacing a length of damaged longitudinal core strip 144 with a replacement longitudinal core strip 144 of the same length to effect both electrical and structural repair or replacement of the original longitudinal core strip 144.

Figure 2:
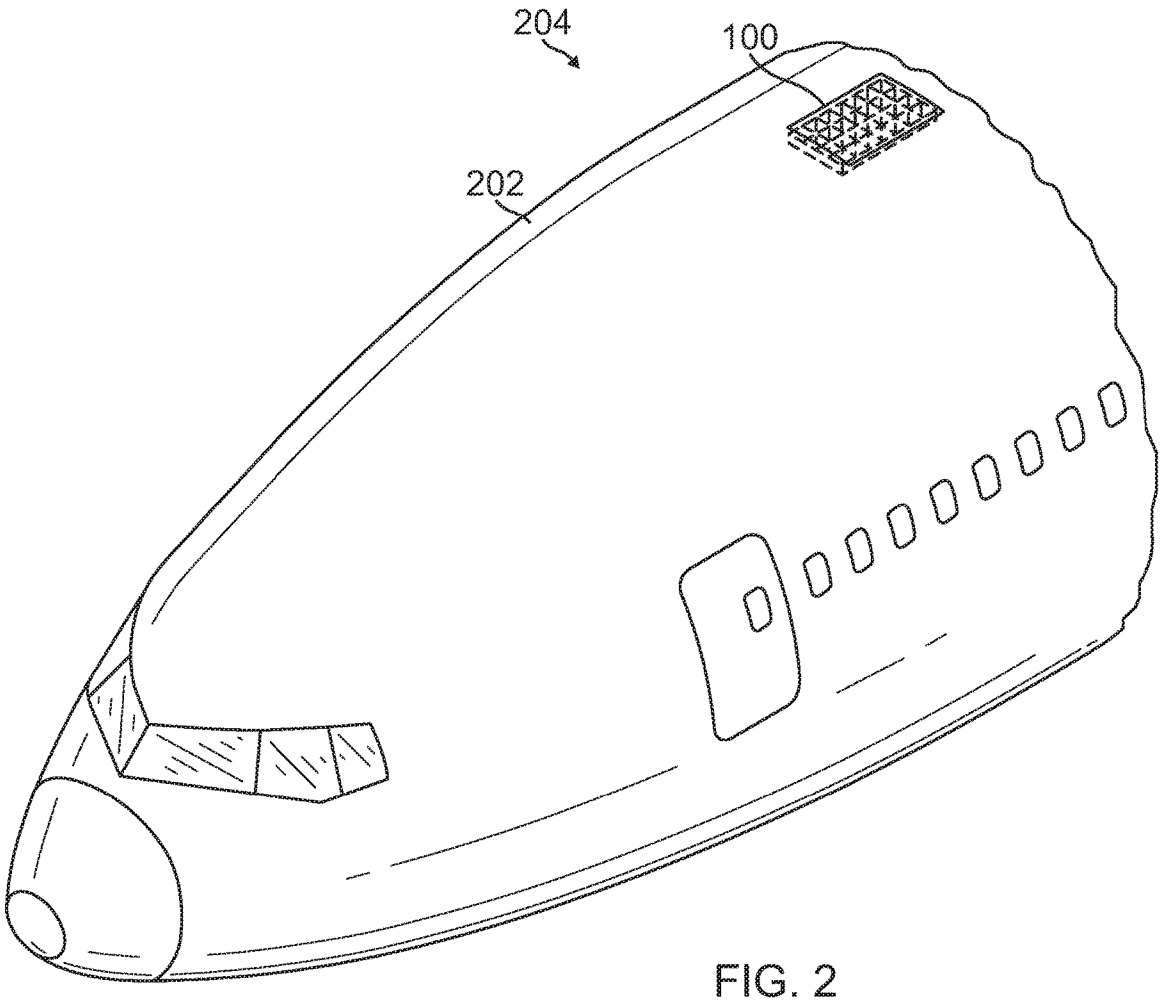
FIG. 2 is a partial perspective diagrammatic view of an aircraft incorporating a multifunctional wideband array into the fuselage structure of the aircraft, in accordance with one embodiment.

FIG. 2 illustrates an aircraft 204 incorporating a multifunctional wideband array 100 into the structure of fuselage 202 of aircraft 204, in accordance with one embodiment. Multifunctional wideband array panel 100 may be a load bearing portion of fuselage 202. A multifunctional wideband array antenna aperture 100 in accordance with one or more embodiments also may be integrated into, or otherwise applied to, wings, stabilizers, flaps, slats, doors, or other structures of aircraft 204. Multifunctional wideband array 100 may be affected by various contingencies affecting aircraft 204. Multifunctional wideband array 100 may incur damage resulting from the impact of debris or other objects on fuselage 202 in the area of antenna aperture 100, for example, while aircraft 204 is in operation. Damage to multifunctional wideband array 100 also may result from excessive stresses placed on the structure into which multifunctional wideband array 100 is integrated, or for example, from other causes or combinations of causes such as excessive heat, lightning strikes, or improper handling of equipment in the area near antenna aperture 100. Such damage may adversely affect either or both of the electrical (e.g., radio frequency phased array antenna) and structural performance of multifunctional wideband array 100. Damage scenarios for the multifunctional wideband array panel 100 may be identified for which corresponding repair solutions may be defined according to one or more embodiments.

Figure 3:
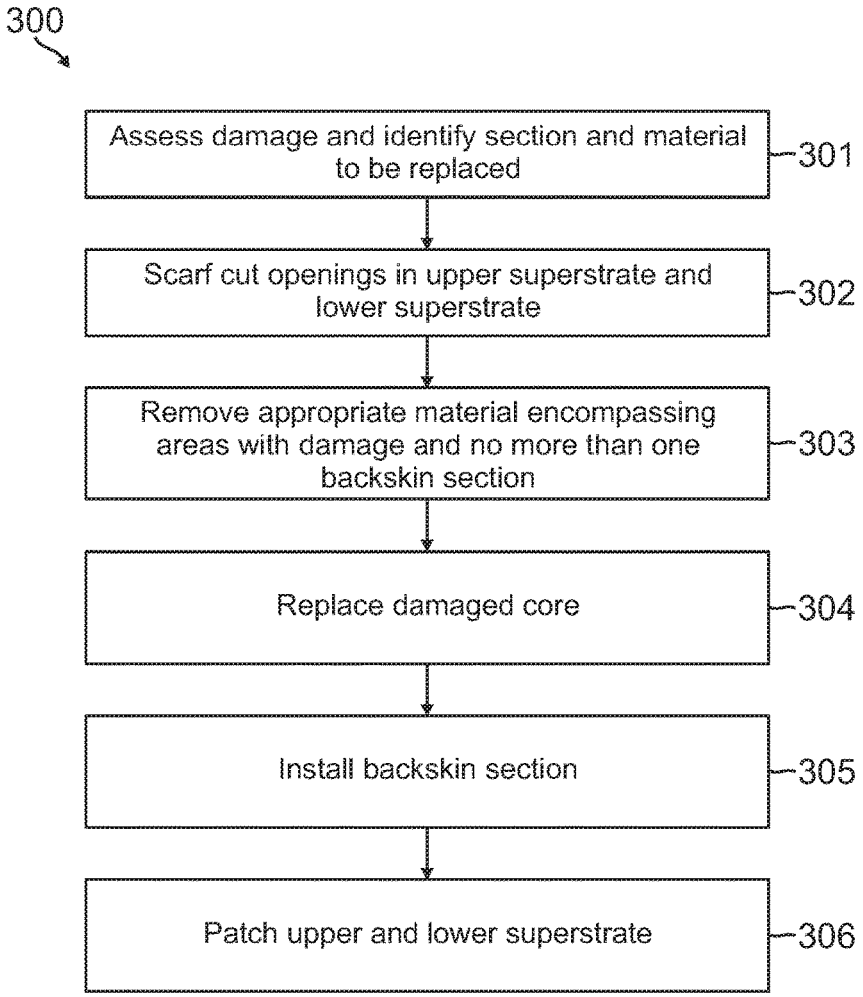
FIG. 3 is a flow diagram illustrating a method for repair of a multifunctional wideband array, according to one or more embodiments.

FIG. 3 illustrates a method 300 for repair of a multifunctional wideband array 100, according to an embodiment. At block 301, method 300 may include operations of assessing damage to identify a damage scenario according to whether there is superstrate (108, 110) damage, and damage to one of the four lower electronic assembly sections (e.g. damage to a section of backskin 106). In a scenario where more than one section of backskin 106 is damaged, panel 100 may not be repaired, and method 300 may include an option to fabricate a whole new panel to replace multifunctional wideband array 100.

Block 301 of method 300 may include operations of inspecting panel 100, identifying a damaged area of the upper superstrate 108, lower superstrate 110, and lower electronic assembly, e.g., backskin 106. Any non-destructive test (NDT) method for determining composite damage may be suitable. Block 301 may include an operation of marking the damaged area or areas for reference. Using the marked damage area as a guide, method 300 may include an operation of determining at block 301 which lower electronic assembly section (e.g. section of backskin 106) is damaged. The entire section of core 104, superstrate 108, superstrate 110, and electronics backskin 106 that includes the damaged lower electronic assembly section may be replaced according to method 300. As noted above, if more than one section of backskin 106 is damaged, a whole new panel may be fabricated according to method 300.

Figure 4A:
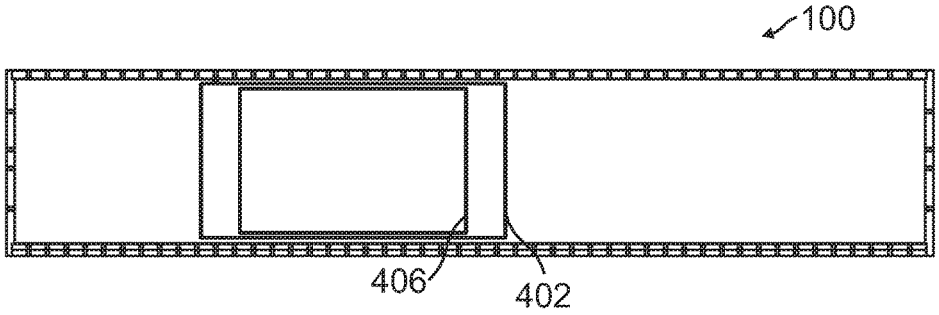
FIG. 4A is a top view of a multifunctional wideband array, according to one or more embodiments, showing markings for a section of panel to be replaced.

FIG. 4A shows a top view of a multifunctional wideband array panel 100 with a marking 402 showing where upper superstrate 108 is to be scarf cut based on the damage assessment of block 301. FIG. 4A also shows an indication 406 of the location of the section of backskin 106 to be replaced based on the damage assessment of block 301.

Figure 4B:
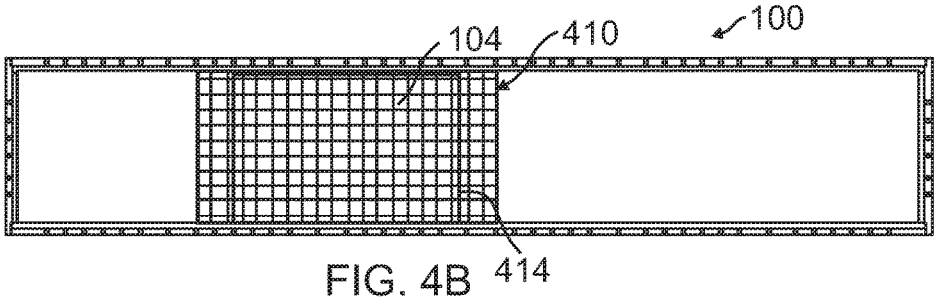
FIG. 4B is a top view of a multifunctional wideband array, according to one or more embodiments, showing removal of a section of superstrate, exposed core, and markings for a section of core to be removed.
Figure 4C:
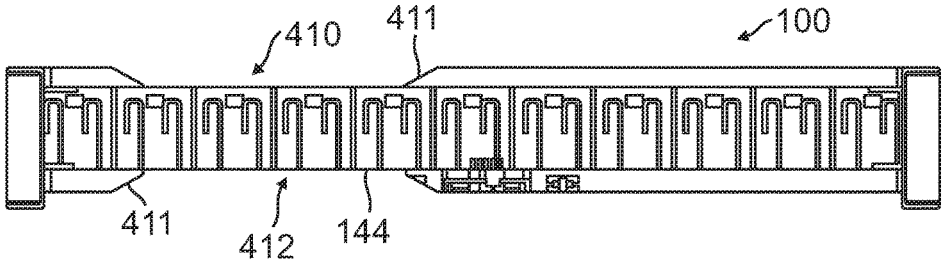
FIG. 4C is a cross sectional side view of (e.g., the cross sectional cut is taken longitudinally along) a multifunctional wideband array, according to one or more embodiments, showing removal of sections of superstrate.
Figure 4D:
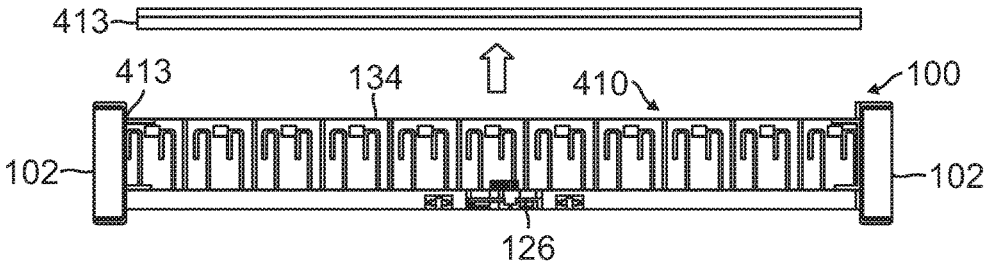
FIG. 4D is a cross sectional end view of (e.g., the cross sectional cut is taken transversely across) a multifunctional wideband array, according to one or more embodiments, showing removal of a section of superstrate.

Block 302 of method 300 may include operations of scarfing (e.g., cutting a tapered edge section) opening 410 in upper superstrate 108 as shown at FIG. 4B, which shows exposed core 104, visible upon removal of the cut section of upper superstrate 108. The tapered edges 411 of the scarf cut are shown more clearly in cross section at FIG. 4C. Openings 410 may encompasses the entire area above and below the damaged electronics section of backskin 106. Each opening 410 should be tapered in the longitudinal direction (e.g., along the transverse sides 411 of the cut indicated by marking 402) and should extend across the entire panel between frames 102, as shown at FIG. 4D. Longitudinal sides 413 of the cut need not be tapered, as seen in FIG. 4D. The opening 410 should extend far enough in the longitudinal direction so that two rows of core cells 104 are exposed beyond the damaged area on either end of opening 410, as indicated by routing path 414 shown in FIG. 4B.

Block 302 of method 300 may further include an operation of flipping panel 100 over to unfasten and remove the connector plate 126 that is attached to the lower electronic assembly section of backskin 106 to be replaced. Block 302 of method 300 may further include scarfing out the entire lower superstrate section corresponding to the damaged area, e.g., opening 412 in lower superstrate 110. As with opening 410 the scarf area of opening 412 should be tapered in the longitudinal direction (e.g., along the transverse sides 411 of opening 412). The scarfed area of opening 412 should be matched to the upper superstrate scarfed area of opening 410. During the scarfing operation on lower superstrate 110, there need be no concern about damaging the backskin 106 or core 104 in the damaged area, as those components will be replaced according to method 300. Upper and lower openings 410, 412 may match each other as shown in FIG. 4C.

Figure 5:
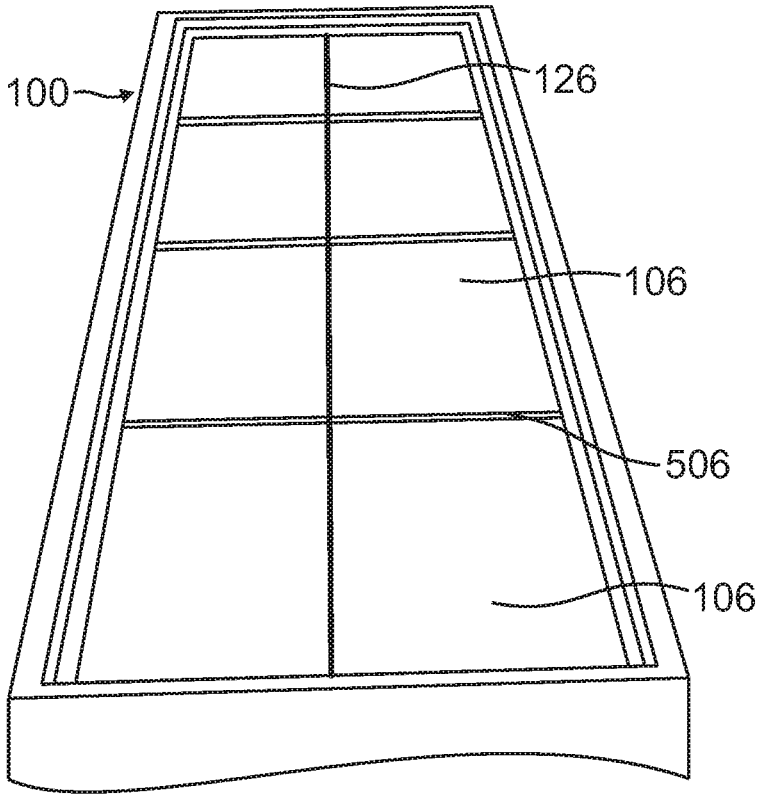
FIG. 5 is a bottom perspective view of a multifunctional wideband array, according to one or more embodiments, showing a bondline between sections of backskin.
Figure 6:
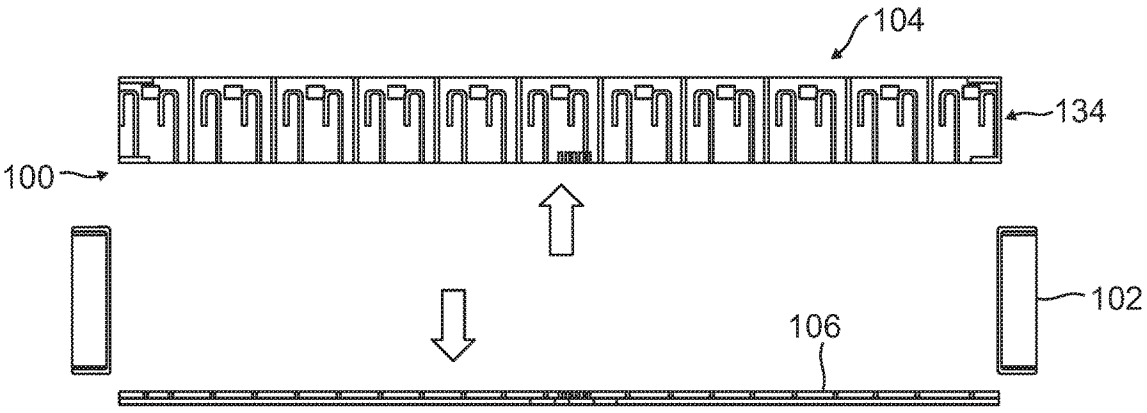
FIG. 6 is a cross sectional end view of a multifunctional wideband array, according to one or more embodiments, showing removal of a section of core and a section of backskin lower electronic assembly.

Block 303 of method 300 may include operations of removing components encompassing damaged areas, which may include a section of backskin 106 that includes the portion of the lower electronic assembly needing to be replaced. FIG. 5 shows a bondline 506 between neighboring sections of backskin 106. Bondline 506 may comprise a number of soldering bonds, for example. Block 303 may include an operation of breaking the soldering bonds holding the damaged section of backskin 106 to the neighboring undamaged backskin section or sections, which may be referred to as established sections of backskin 106. Block 303 may further include an operation of routing out the core 104 that is attached to the damaged (or impaired) section of backskin 106. For example, FIG. 4B routing path 414 that may be followed when using a router to cut out the portion of core 104 needing to be removed for the repair according to method 300. Once the section of core 104 is routed out (see FIG. 6), the damaged section of backskin 106 should fall out (or be free to be to be removed) from multifunctional wideband array panel 100, as indicated in FIG. 6. With the removed section of backskin 106 and its corresponding attached core 104 removed, there should now be an opening 702 completely through panel 100 where the damaged section of backskin 106 used to be, as illustrated by FIG. 7.

Figure 7:
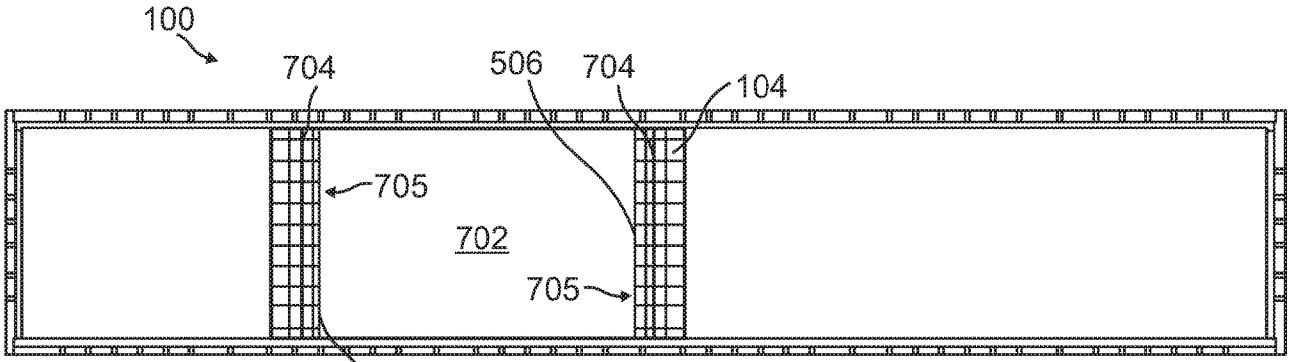
FIG. 7 is a top view of a multifunctional wideband array, according to one or more embodiments, showing removal of damaged components and a cut line for trimming of core.

FIG. 7 shows exposed portions of core 104 remaining attached to established sections of backskin 106 due to opening 410 in substrate 108 extending far enough in the longitudinal direction so that two rows of core cells 104 are exposed beyond the damaged area on either end of opening 410. FIG. 7 shows cut lines 704 where established longitudinal core strips 144 may be cut to trim waste sections 705 of core 104 to be removed from the established sections of backskin 106 remaining with panel 100. The established longitudinal core strips 144, thus, may be cut to trim the established core 104 so that sections of replacement longitudinal core strips 144 will have some overlap with the established sections of backskin 106 remaining with panel 100. Longitudinal cores strips 144 should be square cut one cell in from the backskin bond line 506 as indicated by cut line 704. Cuts in longitudinal cores strips 144 should be made through the capacitive coupling pad 155 as seen at FIG. 10D and also shown at FIG. 11D.

Figure 8:
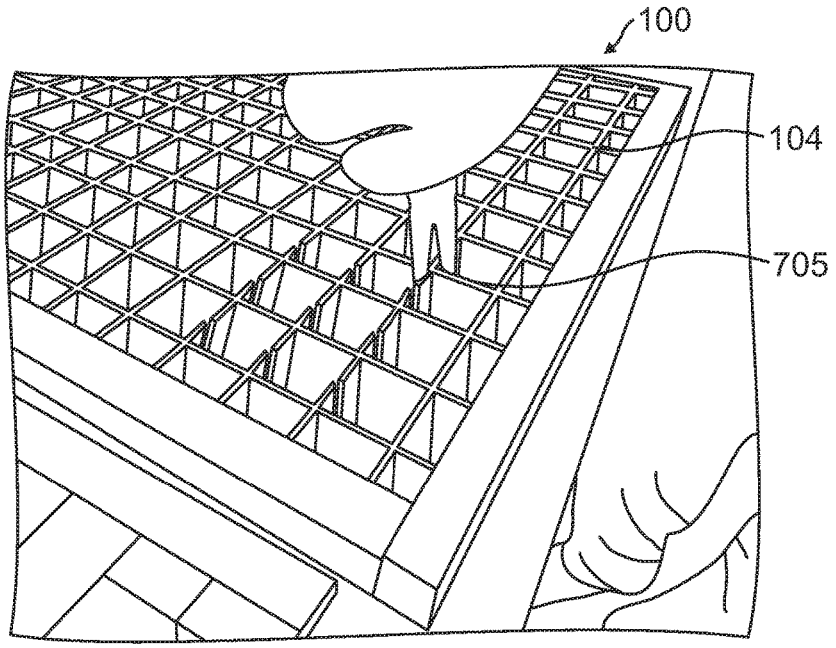
FIG. 8 is a top perspective view of a multifunctional wideband array, according to one or more embodiments, showing removal of trimmed core.

After cutting the waste sections 705 of core 104, panel 100 may be flipped over to access the established sections of backskin 106 and desolder the vias corresponding to the waste sections 705 of core 104 that were just cut. The desoldering may be accomplished, for example, using a soldering iron and solder wick. FIG. 8 illustrates removal of trimming waste sections 705 of core 104 after operations of cutting and desoldering. Removal of trimming waste sections 705 of core 104 may be accomplished using pliers, as shown; cuts may be made in transverse core strips 134 of waste sections 705 of core 104, as seen in FIG. 8, to facilitate removal of waste sections 705 of core 104.

Figure 9:
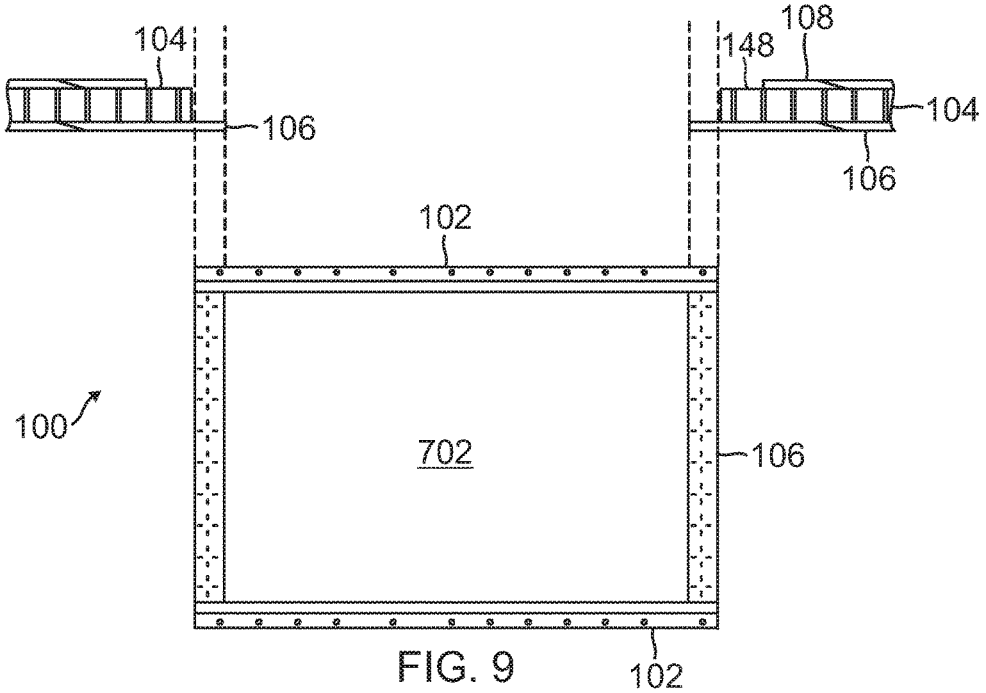
FIG. 9 is a multi-view diagram, comprising a cross sectional side view aligned with a top view, of a multifunctional wideband array, according to one or more embodiments, showing trimmed core in relation to established backskin sections.

FIG. 9 illustrates the condition of opening 702 in panel 100 subsequent to removal of waste sections 705 of core 104, showing the longitudinal alignment of the remaining established sections of backskin 106 and core 104. At each of the ends of longitudinal cores strips 144 where the established core 104 was cut (e.g., established core strips 148, also shown in FIG. 10D), the copper traces (e.g., signal trace 156 and ground element 157 as shown in FIG. 11D) and capacitive coupling pad 155 (also shown in FIG. 11D) should be exposed for bonding and electronic purposes (e.g., splicing of the core strips 144). The copper traces and capacitive coupling pads may be exposed for splicing by grinding away the resin transfer molding (e.g., RTM-6) adhesive and solder mask. The established core strip 148 ends may be cleaned, for example with isopropyl alcohol, to ensure the surfaces are uncontaminated for bonding and electronic purposes.

Block 304 of method 300 may include operations of replacing the portion of core 104 that was removed from panel 100. The operations may comprise acquiring a required number of standard repair core strips (e.g., transverse repair core strips 136 and longitudinal repair core strips 146) that correspond to the removed section of core 104. The standard repair core strips may be used, according to method 300, to replace the removed core 104.

The repair core strips may be standardized in that an inventory of the repair core strips may need to be kept only for a limited number of standard choices for the length of such strips, and the strips may be manufactured to conform to a small number (e.g., less than 10) of standardized lengths. For example, transverse repair core strips 136 may only need to be kept for a length or lengths that match the width of an end portion 116 of a frame 102 for each size of a standard panel 100. Because method 300 specifies to replace a single section of backskin and specifies the length to trim longitudinal core strips 144 one cell in from the edge (backskin bondline 506) of established backskin sections (see, e.g., description of block 303 and FIG. 7), longitudinal repair core strips 146 may only need to be kept for a length or lengths that match those needed to fill in across a single removed standard section of backskin 106 for each size of a standard panel 100. For example, only one length of standard longitudinal repair core strip 146 may be needed; in other words, standard longitudinal repair core strip 146 may be manufactured in only one length. The standard repair core strips 136, 146 may have reversed slots from the established core 104 (e.g., core strips 134, 144) that is in the panel 100. The upwards slots may be in the transverse repair core strips 136, and the downwards slots may be in the longitudinal repair core strips 146.

Figure 10A:
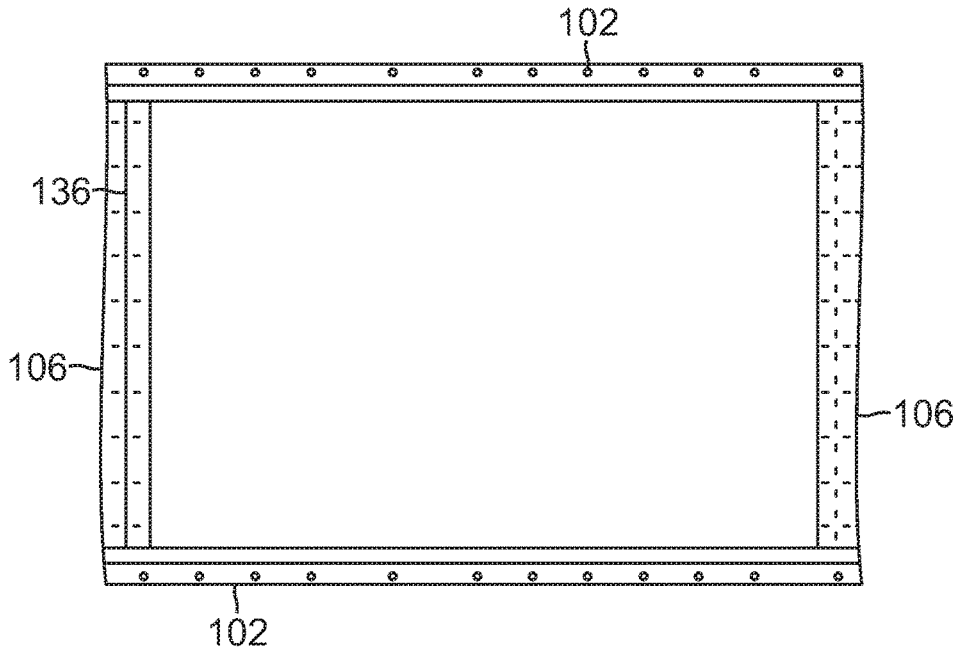
FIG. 10A is a top view of a multifunctional wideband array, according to one or more embodiments, showing replacement of a transverse core strip.

Replacement of the removed section of core 104 may begin (as shown at FIG. 10A) by inserting a transverse repair core strip 136 into the frame flanges 102. Care should be taken to insert the core feet 105 (see FIG. 11C) of transverse repair core strip 136 securely into the vias of established section of backskin 106 as shown in FIG. 10A. Panel 100 may be flipped over at this point in the performance of method 300, and the vias of the established section of backskin 106 may be soldered to solder each of the new core feet 105 into the established backskin 106, however, this soldering operation for the established backskin 106 may be performed later, at block 305 of method 300, when the replacement section of backskin 106 is installed. The operation of inserting a transverse repair core strip 136 into the frame flanges 102 may be repeated with all of the transverse repair core strips 136 that need to be inserted.

Figure 10B:
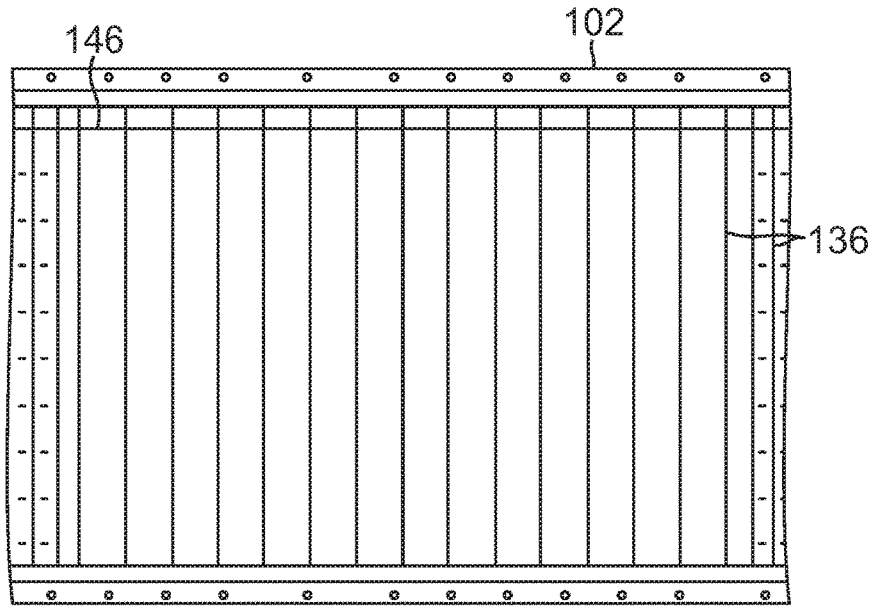
FIG. 10B is a top view of a multifunctional wideband array, according to one or more embodiments, showing replacement of a longitudinal core strip.

Block 304 of method 300 may continue with operations of inserting a longitudinal repair core strip 146 as shown at FIG. 10B. Core feet 105 of the longitudinal repair core strip 146 may need to be inserted into the vias of the established sections of backskin 106. Panel 100 may be flipped over at this point in the performance of method 300, and the vias of the established section of backskin 106 may be soldered to solder each of the new core feet 105 into the established backskin 106, however, this soldering operation for the established backskin 106 may be performed later, at block 305 of method 300, when the replacement section of backskin 106 is installed.

Figure 10C:
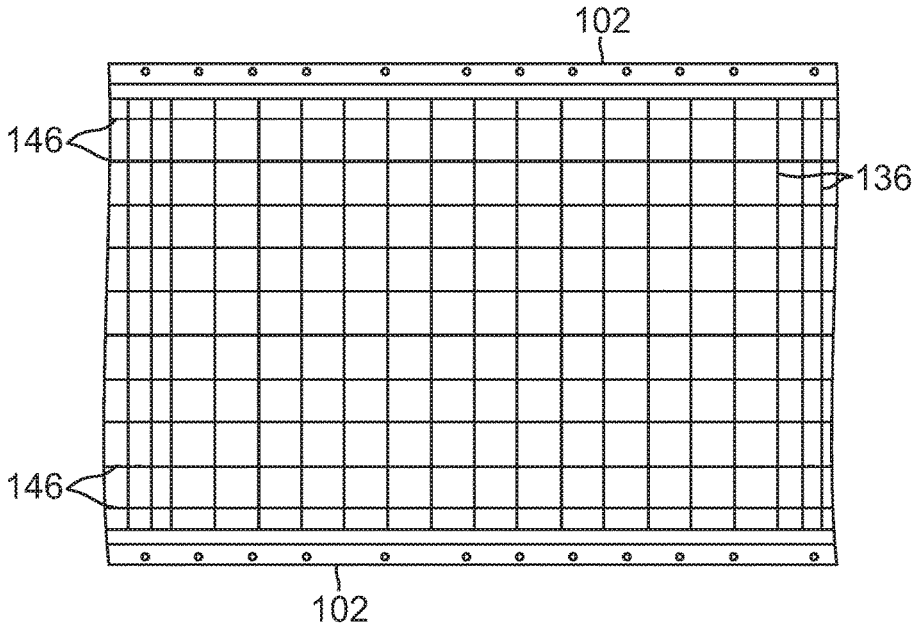
FIG. 10C is a top view of a multifunctional wideband array, according to one or more embodiments, showing replacement of all transverse and longitudinal core strips.
Figure 10D:
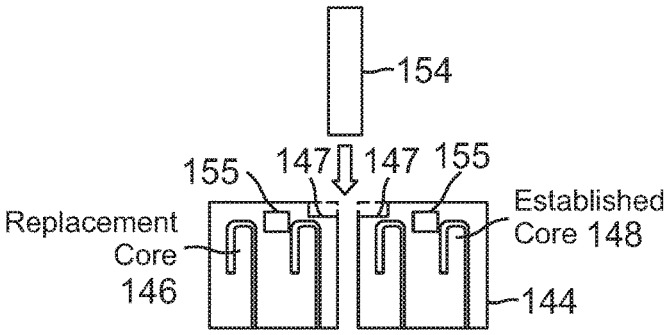
FIG. 10D is a side view of a longitudinal core strip of a multifunctional wideband array, according to one or more embodiments, showing insertion of a splice clip.
Figure 11A:
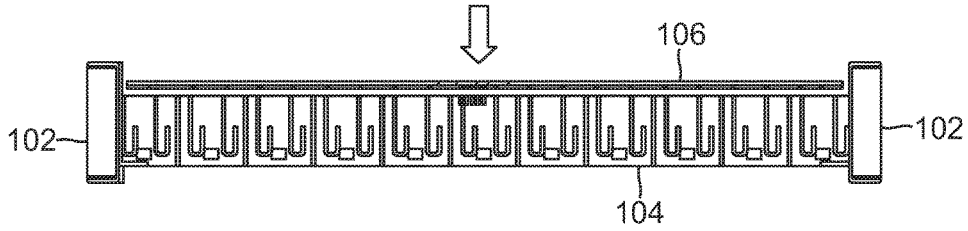
FIG. 11A is a cross sectional end view of a multifunctional wideband array, according to one or more embodiments, showing replacement of a section of backskin of a lower electronics assembly of the multifunctional wideband array.
Figure 11B:
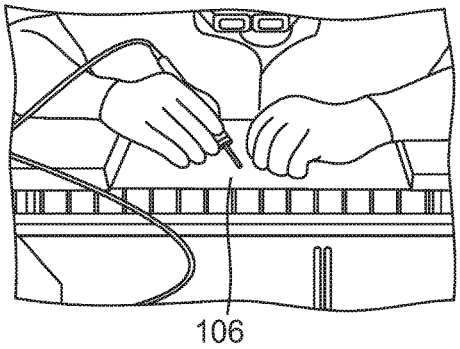
FIG. 11B is a perspective view of a multifunctional wideband array, according to one or more embodiments, showing installation of the section of backskin.

The slots of the longitudinal repair core strip 146 may be used to mate with slots of each of the inserted transverse repair core strips 136 to align the transverse repair core strips 136 to be parallel as shown in FIGS. 10B and 10C. There should be about a 0.02 inch gap between the end of the replacement longitudinal repair core strip 146 and the end of the established core (each longitudinal core strip 144 as seen at FIG. 10D) on both sides (e.g., each end of longitudinal repair core strip 146). A small amount of material may be removed from the established longitudinal core strip 144 to form a notch 147 as illustrated at FIG. 10D. Standard repair strip 146 may be provided with a corresponding notch 147 as illustrated at FIG. 10D, or a small amount of material also may be removed from the repair strip 146 to form corresponding notch 147. The notches 147 may provide room at the splice joint for the splice clip 154. Splice clips 154 should be applied at each end of longitudinal repair core strip 146. Application of splice clips 154 integrates the replacement strip 146 into the established core 104. This process should be repeated for all of the longitudinal repair core strips 146 that need to be inserted, as illustrated by FIG. 10C.

Block 305 of method 300 may include operations of installing a replacement section of backskin 106 for the lower electronics assembly. Subsequent to all of the needed transverse repair core strips 136 and longitudinal repair core strips 146 being inserted and integrated into core 104, panel 100 may be flipped over for access to the "lower" side of panel 100. Installation of a new or replacement backskin electronics panel (e.g., section of backskin 106) may begin by placing the replacement section of backskin 106 onto the core feet 105 of the newly integrated core 104. FIG. 11A illustrates fitting and alignment of replacement section of backskin 106 to newly integrated core 104 in the transverse direction, and FIG. 9 may be helpful for reference with regard to fitting and alignment of replacement section of backskin 106 in the longitudinal direction. Care should be taken that panel 100 lies flat across the newly integrated core section 104 with the core feet 105 of the newly integrated core section 104 securely inserted into the vias of the replacement section of backskin 106.

Figure 11C:
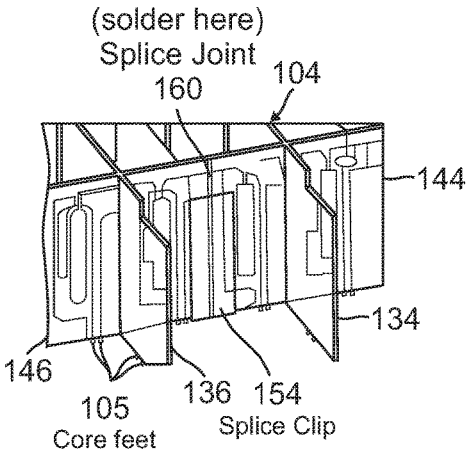
FIG. 11C is a perspective view of a detail of a core of a multifunctional wideband array, showing soldering of a splice clip, according to one or more embodiments.
Figure 11D:
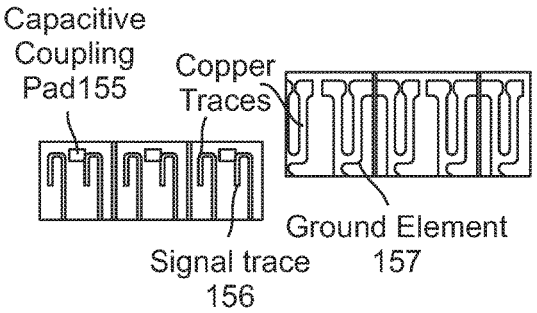
FIG. 11D is a detail diagram of two portions of a core strip of a multifunctional wideband array, according to one or more embodiments.

Each of the new core feet 105 (e.g., core feet belonging to a newly integrated transverse repair core strip 136 or longitudinal repair core strip 146, see FIG. 11C) should be soldered into the new or replacement backskin panel, e.g., replacement section of backskin 106. As noted above, any new core feet 105 needing to be soldered to an established section of backskin 106 may also be soldered at this time. The replacement section of backskin 106 should also be soldered to the neighboring sections of backskin 106 on either side of the replacement backskin 106, for example, along bondlines 506. FIG. 11B provides an illustration of soldering a replacement backskin 106 panel.

Panel 100 may be flipped back over for access to the "upper" side of panel 100. Solder should be applied across each of the longitudinal core strip splice joints 160, as shown at FIG. 11C.

Figure 11E:
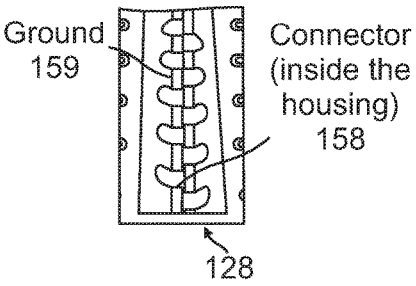
FIG. 11E is a detail diagram of a portion of a backskin of a multifunctional wideband array, according to one or more embodiments.

Method 300 may then continue with conducting a direct current (DC) continuity check in order to confirm that all the elements of multifunctional wideband array 100 (e.g., capacitive coupling pads 155, signal traces 156, ground elements 157) and electrical interconnects (e.g., capacitive coupling pads 155, core strip splice joints 160, connectors 158) are working properly (see FIG. 11D). For example, check continuity from the signal trace 156 to the respective connector 158; check continuity from the ground elements 157 to a ground 159 (see FIG. 11E). If any test fails, determine where the faulty connection or element is located and resolve the problem. Once all checks for electrical function of the replacement core 104 and backskin 106 are passed, method 300 may proceed to bonding of the replacement core 104 and backskin 106.

Figure 12:
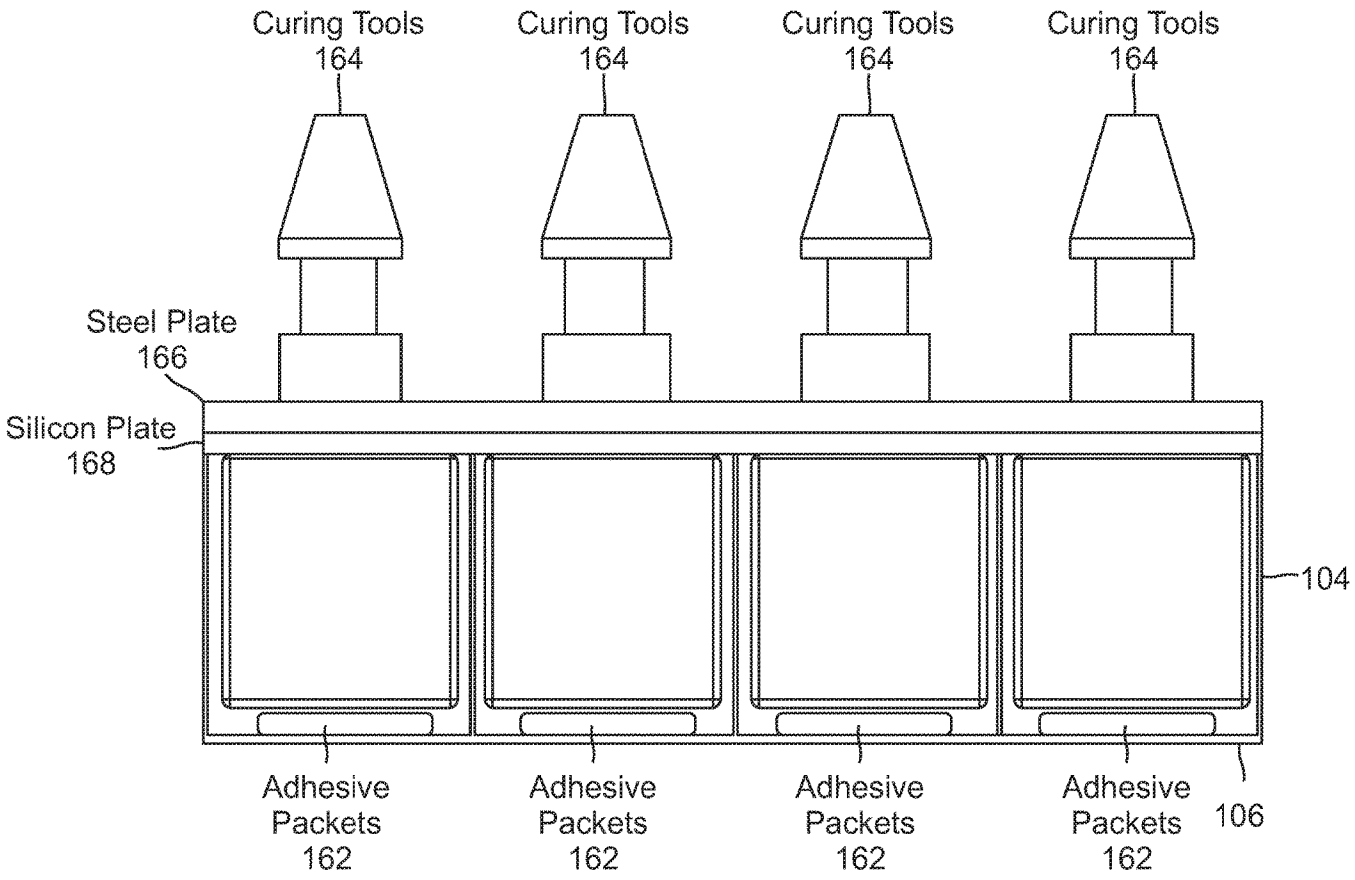
FIG. 12 is a detail diagram of a portion of a core of a multifunctional wideband array, according to one or more embodiments, showing bonding of core and backskin elements.

As illustrated in FIG. 12, method 300 may continue with inserting of adhesive packets 162 (for example, AF 163 thermosetting epoxy adhesive may be used) into each of the core cells of the newly integrated core section 104, and inserting a curing tool 164 into each of these core cells. Curing tools 164 along with steel plate 166 and silicon plate 168 may be configured to conduct heat to each of core cells containing an adhesive packet 162 to cure the adhesive. Thus, method 300 may include operations of bonding the replacement core 104 and replacement section of backskin 106. Additional operations may include removing the adhesive packet curing tools 164, plates 166, 168, and cleaning away the excess adhesive.

Block 306 of method 300 may include operations of repairing the upper superstrate 108 and lower superstrate 110 and completing repair of multifunctional wideband array panel 100. The operations may comprise acquiring a standard superstrate repair patch 172 to fit in the upper superstrate 108 tapered hole 410.

As with the standard core repair strips, upper superstrate repair patch 172 and lower superstrate repair patch 174 (see FIGS. 13A, 13B) may be standardized in that an inventory of the superstrate repair patches may need to be kept only for a limited number of choices for the sizes of such superstrate repair patches. For example, superstrate repair patches may only need to be kept for a width or widths that match the width of an end portion 116 of a frame 102 for each size of a standard panel 100. Because method 300 specifies to replace a single section of backskin and specifies the length to trim longitudinal core strips relative to the length of established backskin sections superstrate repair patches may only need to be kept for a length or lengths that match those needed to fill in across a single removed standard section of backskin 106 for each size of a standard panel 100.

Block 306 may continue with bonding on a superstrate repair patch 172 into the tapered hole 410 of upper superstrate 108 using a low temperature supported thin film adhesive 173 between the upper superstrate 108 and upper superstrate repair patch 172 and an unsupported adhesive 171 between the core 104 and the upper superstrate repair patch 172. A supported adhesive is one for which a substrate or additive is added to the adhesive film. The additive or substrate often consists of a nylon woven or knitted fabric or even a non-woven scrim to provide a control and restraint over minimum bond line thickness, or to prevent the liquefying adhesive from flowing, for example, into the core material. An unsupported adhesive is one without a substrate or additive, and may be used for wetting of an adhesive area.

Figure 13A:
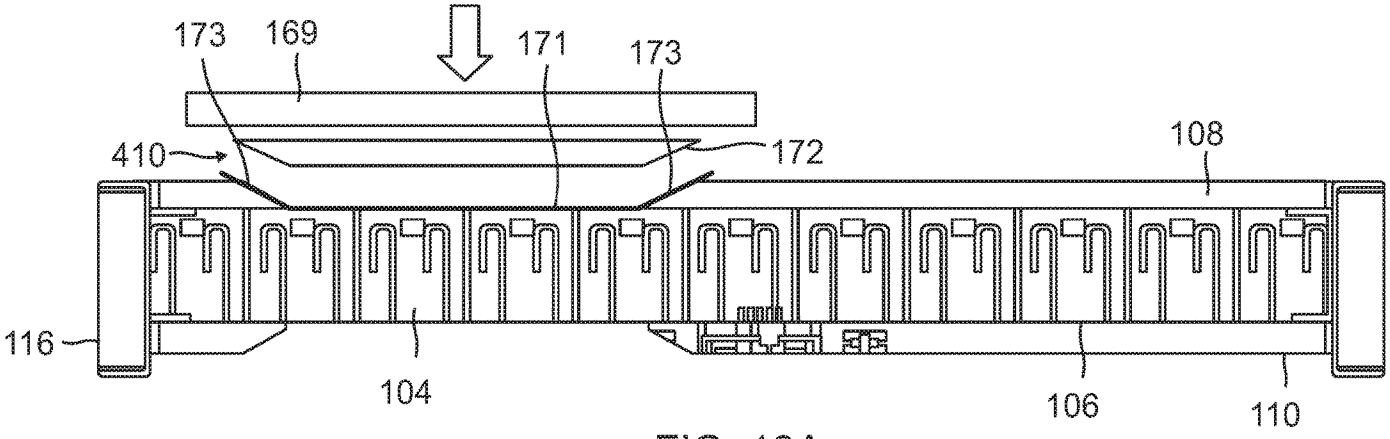
FIG. 13A is a cross sectional side view of a multifunctional wideband array, according to one or more embodiments, illustrating repair of an upper superstrate.

A plate 169 may be applied on top of the bond (as illustrated in FIG. 13A) while curing in order to establish solid contact between surfaces of the upper superstrate 108, upper superstrate repair patch 172, and core 104 to be bonded together. Care should be taken to ensure that the surface of panel 100 sits flush to the outside mold line (OML) for the structure into which it is to be installed.

Figure 13B:
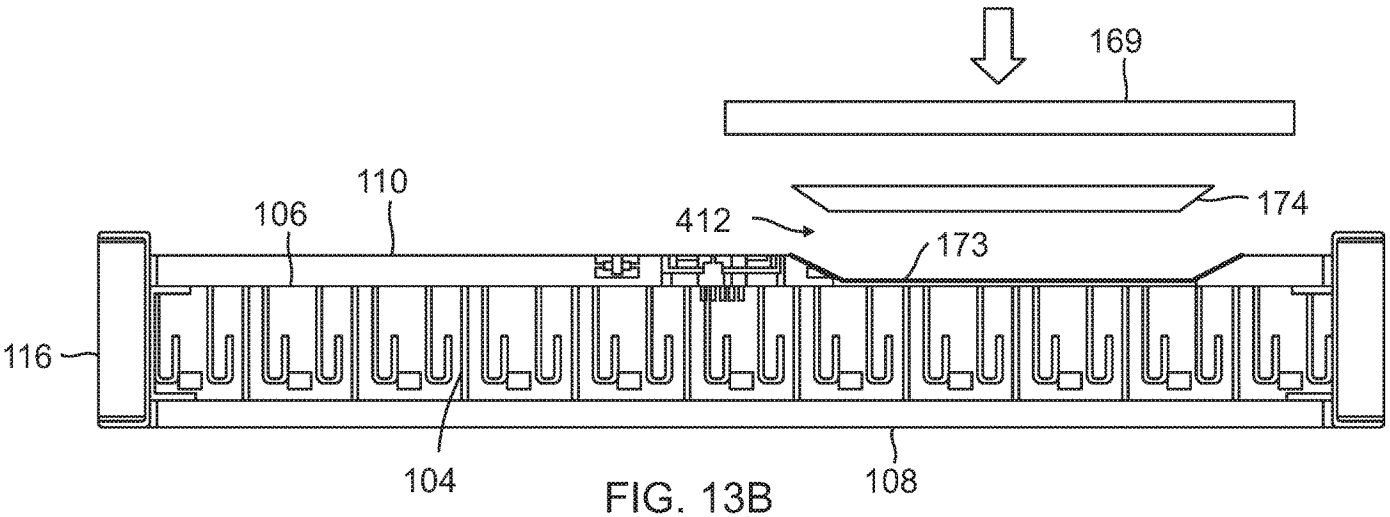
FIG. 13B is a cross sectional side view of a multifunctional wideband array, according to one or more embodiments, illustrating repair of a lower superstrate.

Block 306 may continue with acquiring an additional standard superstrate repair patch, e.g., lower superstrate repair patch 174, to fit in the lower tapered hole 412. Panel 100 may be flipped over to provide easier access to the "lower" side of panel 100 and replacement section of backskin 106. Block 306 may continue with bonding on lower superstrate repair patch 174 into the tapered hole 412 of lower superstrate 110 using a low temperature supported thin film adhesive 173 between the lower superstrate 110 and lower superstrate repair patch 174 and between the replacement section of backskin 106 and the lower superstrate repair patch 174. A plate 169 may be applied on top of the bond (as illustrated in FIG. 13B) while curing in order to establish solid contact between surfaces of the lower superstrate 110, lower superstrate repair patch 174, and replacement section of backskin 106 to be bonded together. Care should be taken to ensure that the surface of panel 100 sits flush to the outside mold line (OML) for panel 100. Repair of multifunctional wideband array panel 100 may be completed by re-fastening the connector plate 126.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. A method for repair of a multifunctional wideband array comprising:

identifying an impaired backskin section of a plurality of backskin sections, each backskin section comprising a plurality of electronics components and a backskin structure and coupled to the multifunctional wideband array;

cutting an opening in a superstrate of the multifunctional wideband array to expose the impaired backskin section;

replacing the impaired backskin section with a replacement backskin section comprising:

removing the impaired backskin section;

desoldering the impaired backskin section from an established backskin section, wherein the established backskin section forms a part of the plurality of backskin sections;

soldering the replacement backskin section to the established backskin section; and repairing the opening in the superstrate.

2. The method of claim 1, wherein replacing the impaired backskin section comprises:

furnishing a plurality of core feet;

inserting the plurality of core feet into vias of the replacement backskin section;

soldering the vias to the plurality of core feet; and placing the replacement backskin section adjacent to the opening;

wherein the identifying comprises performing a non-destructive test of the multifunctional wideband array.

3. The method of claim 1, wherein each of the plurality of backskin sections are electrically coupled to a plurality of core cells of a core, the method further comprising:

removing core cells corresponding to the impaired backskin section;

replacing the core cells using standard core repair strips; and soldering the replacement backskin to the standard core repair strips of the replaced core cells, wherein the plurality of electronics components of the backskin sections provide electrical functionality enabling the plurality of core cells of the core to function as a phased array antenna aperture.

4. The method of claim 1, further comprising:

breaking a soldering bond along a bondline between the impaired backskin section and an established section of backskin, wherein the established section of backskin forms a part of the plurality of backskin sections;

removing the impaired backskin section from the multifunctional wideband array, leaving an opening adjacent a section of established backskin having the bondline along an edge of the section of established backskin;

trimming a longitudinal core strip one core cell in from the bondline toward the section of established backskin; and replacing the longitudinal core strip with a standard repair core strip fitted to extend one core cell in from the bondline overlapping the section of established backskin.

5. The method of claim 4, wherein trimming the longitudinal core strip further comprises making a cut through a capacitive coupling pad of the longitudinal core strip.

6. The method of claim 1, further comprising:

removing a section of core corresponding to the impaired backskin section;

trimming and removing a section of core corresponding to an established backskin section adjacent to the impaired backskin section;

installing a section of replacement core overlapping the established backskin section; and inserting at least one of a plurality of core feet of the section of replacement core into a via of the established backskin section.

7. The method of claim 1, further comprising:

removing a section of core corresponding to the impaired backskin section;

trimming and removing a section of core corresponding to an established backskin section adjacent to the impaired backskin section;

installing a section of replacement core overlapping the established backskin section; and inserting at least one of a plurality of core feet of the section of replacement core into a via of the replacement backskin section.

8. The method of claim 1, further comprising:

removing a section of core corresponding to the impaired backskin section;

trimming and removing a section of core corresponding to an established backskin section adjacent to the impaired backskin section;

inserting a longitudinal repair core strip between two longitudinal core strips of the multifunctional wideband array; and inserting a splice clip between the longitudinal repair core strip and at least one of the two longitudinal core strips.

9. The method of claim 1, further comprising:

removing a section of core corresponding to the impaired backskin section;

trimming and removing a section of core corresponding to an established backskin section adjacent to the impaired backskin section;

inserting a longitudinal repair core strip between two longitudinal core strips of the multifunctional wideband array forming at least one longitudinal core strip splice joint between the longitudinal repair core strip and at least one of the two longitudinal core strips; and soldering across the longitudinal core strip splice joint.

10. The method of claim 1, further comprising conducting an electrical continuity check between the replacement backskin section and electrical elements of the multifunctional wideband array.

11. The method of claim 1, wherein cutting the opening in the superstrate further comprises cutting a standard sized, scarfed opening.

12. The method of claim 1, wherein repairing the opening in the superstrate further comprises bonding a standard sized, tapered repair patch to the superstrate.

13. The method of claim 1, further comprising:

maintaining an inventory of standardized longitudinal repair core strips and transverse repair core strips;

maintaining an inventory of standardized superstrate repair patches;

removing no more than the impaired backskin section from a damaged multifunctional wideband array panel;

wherein the cutting comprises cutting a standard sized, scarfed opening in the superstrate of the damaged multifunctional wideband array panel corresponding to the impaired backskin section;

removing a section of the core corresponding to the impaired backskin section;

wherein the method further comprises:

trimming a remaining section of the core attached to a remaining section of the plurality of backskin sections to match a standardized length of one of the inventory of standardized longitudinal repair core strips;

removing the trimmed section of the core;

replacing the removed trimmed section of the core using the standardized longitudinal repair core strips and transverse repair core strips;

installing the replacement backskin section to replace the impaired backskin section, comprising inserting a plurality of core feet of the longitudinal repair core strips and transverse repair core strips into vias of the replacement backskin section, soldering the vias, and soldering the replacement backskin section to an established backskin; and repairing the standard sized, scarfed opening using one of the inventory of standardized superstrate repair patches.

14. A method comprising:

identifying an impaired backskin section of a plurality of backskin sections, each backskin section comprising a plurality of electronics components and a backskin structure and coupled to a multifunctional wideband array, wherein each of the plurality of backskin sections are electrically coupled to a plurality of core cells of a core;

cutting an opening in a superstrate of the multifunctional wideband array to expose the impaired backskin section;

replacing the impaired backskin section with a replacement backskin section comprising:

removing core cells corresponding to the impaired backskin section;

replacing the core cells using standard core repair strips; and soldering the replacement backskin to the standard core repair strips of the replaced core cells, wherein the plurality of electronics components of the backskin sections provide electrical functionality enabling the plurality of core cells of the core to function as a phased array antenna aperture; and repairing the opening in the superstrate.

15. A method comprising:

identifying an impaired backskin section of a plurality of backskin sections, each backskin section comprising a plurality of electronics components and a backskin structure and coupled to a multifunctional wideband array, wherein each of the plurality of backskin sections are electrically coupled to a plurality of core cells of a core;

cutting an opening in a superstrate of the multifunctional wideband array to expose the impaired backskin section;

replacing the impaired backskin section with a replacement backskin section comprising:

breaking a soldering bond along a bondline between the impaired backskin section and an established section of backskin, wherein the established section of backskin forms a part of the plurality of backskin sections;

removing the impaired backskin section from the multifunctional wideband array, leaving an opening adjacent a section of established backskin having the bondline along an edge of the section of established backskin;

trimming a longitudinal core strip one core cell in from the bondline toward the section of established backskin; and replacing the longitudinal core strip with a standard repair core strip fitted to extend one core cell in from the bondline overlapping the section of established backskin; and repairing the opening in the superstrate.

* * * * *